US005083318A

United States Patent [19]

Hook

[11] Patent Number: 5,083,318

[45] Date of Patent: Jan. 28, 1992

[54] HEADWRAP FOR CHEMOTHERAPY PATIENTS

[76] Inventor: Chalanda M. Hook, 13602 Windhaven St., Houston, Tex. 77049

[21] Appl. No.: 527,576

[22] Filed: May 24, 1990

[51] Int. Cl.[5] ..... A42B 5/00

[52] U.S. Cl. ..... 2/207; 2/174

[58] Field of Search ..... 2/207, 174, DIG. 11, 2/171, 195, 198, 199, 200, 201, 410; 128/155, 156, 163

[56] References Cited

U.S. PATENT DOCUMENTS

| | | | |
|---|---|---|---|
| 1,002,060 | 8/1911 | Hill | 2/174 |
| 1,610,089 | 12/1926 | Heitler | 128/155 |
| 1,897,146 | 2/1933 | Richardson | 128/163 |
| 1,991,982 | 2/1935 | Hodges | 2/174 |
| 2,464,007 | 3/1949 | Towle | 2/207 |
| 2,993,211 | 7/1961 | Sullivan | 2/207 |
| 3,238,536 | 3/1966 | Gettinger | 2/207 |
| 3,466,665 | 9/1969 | Mooney | 2/207 |
| 3,480,970 | 12/1969 | Gettinger | 2/207 |
| 3,541,610 | 11/1970 | Gettinger | 2/207 |
| 4,218,777 | 8/1980 | Munnikhuysen | 2/174 |
| 4,599,749 | 7/1986 | Childs | 2/207 |
| 4,644,588 | 2/1987 | Zawacki | 128/163 |
| 4,653,492 | 3/1987 | Parsons | 128/155 |
| 4,665,909 | 5/1987 | Trainor | 128/155 |
| 4,734,320 | 3/1988 | Ohira | 128/155 |
| 4,790,035 | 12/1988 | Whyte | 2/207 |
| 4,870,707 | 10/1989 | Hayes | 2/207 |
| 4,964,175 | 10/1990 | Taylor | 2/174 |

FOREIGN PATENT DOCUMENTS

| | | | |
|---|---|---|---|
| 613894 | 2/1961 | Canada | 128/155 |
| 1183208 | 7/1959 | France | 2/174 |
| 2285112 | 4/1976 | France | 128/155 |
| 431663 | 6/1934 | United Kingdom | 128/155 |

OTHER PUBLICATIONS

Company Store Advertisement, Sep. 20, 1988 "Down Velcro Headband".

*Primary Examiner*—Werner H. Schroederl
*Assistant Examiner*—Diana L. Biefeld
*Attorney, Agent, or Firm*—Ezra L. Schacht

[57] ABSTRACT

Cancer patients undergoing chemotherapy frequently experience the tragedy of total hair loss. Women and children, in particular, require suitable head covering, wherever they may be, during this trying time. A most versatile and useful headwrap is made from knit cottom, which retain body heat. The headwrap is long, wide in the center, and tapers to a point on both ends. Tapering allows the wrap to be tied in several distinct ways, creating many stylish looks. When the wrap is properly "dressed" and its tapered ends secured, it can be worn with, and under, the wearer's hats, and accented with fashion pins. The versatility of the headwrap is shown in its alernate stylish use as a belt or cummerbund.

1 Claim, 3 Drawing Sheets

FIG. 6
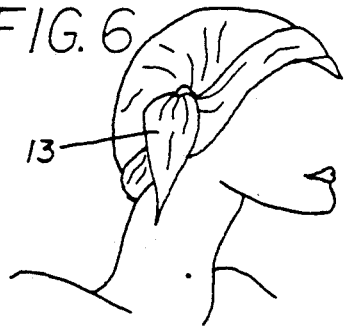
FIG. 7
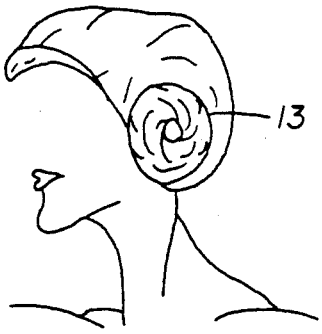
FIG. 8
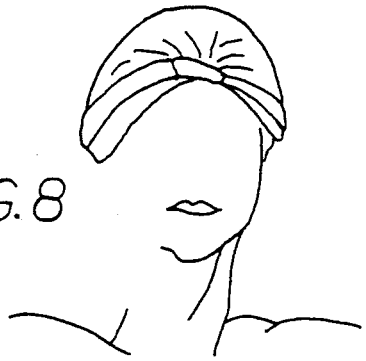
FIG. 9
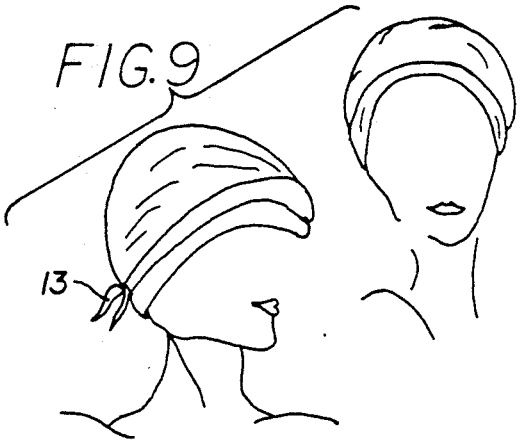
FIG. 10
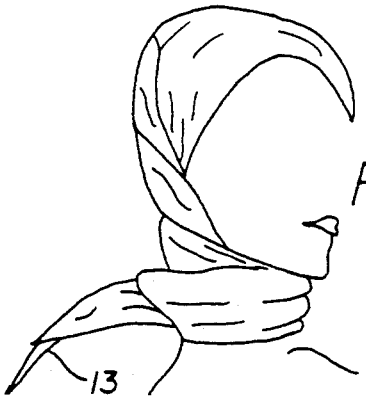
FIG. 11
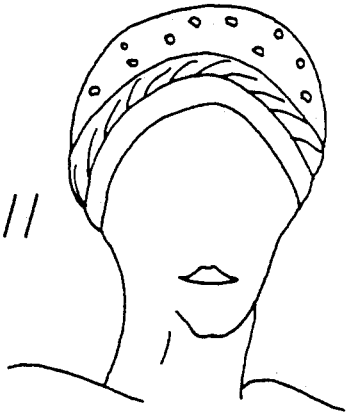
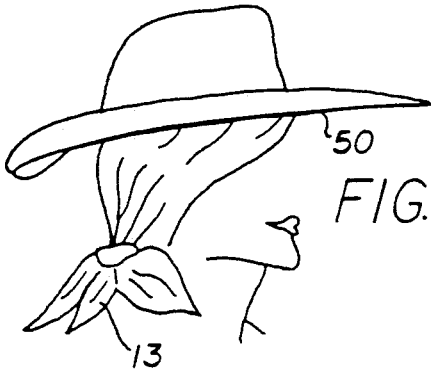
FIG. 12
FIG. 13
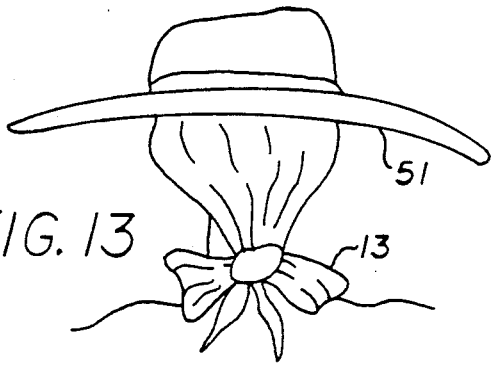

HEADWRAP FOR CHEMOTHERAPY PATIENTS

BACKGROUND OF THE INVENTION

Cancer patients undergoing chemotherapy frequently experience the tragedy of total hair loss. Women and children, in particular, require suitable head covering, wherever they may be, during this trying time.

Wigs are uncomfortable, and likely to be removed by child patients. Experimentation by this inventor with many shapes and sizes of headwraps made of various materials proved discouraging. For example, headwraps of silk do not retain the body heat, and the head remains cold. Silk also is a thin fabric which slips easily from the head of the wearer and causes the patient to feel that the headwrap may be lost at some inappropriate moment, exposing an embarrassing disfigurement to the world.

With headwraps made of cotton, the square shape is bulky because of too much material; an oblong style is not wide enough for proper coverage, and further limits the design to one style.

PREFERRED EMBODIMENT OF THE INVENTION

A most versatile and useful headwrap proved to be the preferred embodiment. It is made from knit cotton, which retains the body heat. The headwrap is long, wide in the center, and tapers to a point on both ends. Tapering allows the wrap to be tied in several distinct ways, creating many stylish looks. When the wrap is properly "dressed" and its tapered ends secured, it can be worn with, and under, the wearer's hats, and accented with fashion pins.

The wrap conforms to the shape of the head, providing a secure fit. It can be made of fabric in one or many colors, and is easy to coordinate with the wearer's wardrobe. It appeals to children undergoing chemotherapeutic treatment.

The headwrap has been tested by the inventor on her own head in the market of the "public" in the City of Houston for the past eight months during her own chemotherapy treatment. The wrap proved comfortable, gave her a secure feeling, and she was not ashamed to wear it. She was complimented many times on the stylish appearance, and was frequently asked if, where, and when, the headwrap could be purchased. The response has convinced her of the obvious need and desire for the invention, and the probable commercial success of her planned manufacture of the wraps.

The objects and advantages of the invention, having been outlined in the preceding paragraphs, are further detailed in the following drawings, description and claims.

BRIEF DESCRIPTION OF THE DRAWINGS

FIGS. 6, 7, 8, 9, 10, 11, 12 and 13 are pictorial views of other methods of arranging the headwrap, with and without accessories, including some with hats, starting from the basic position shown in FIG. 1.

ALTERNATE EMBODIMENTS OF THE INVENTION

Figure 1:
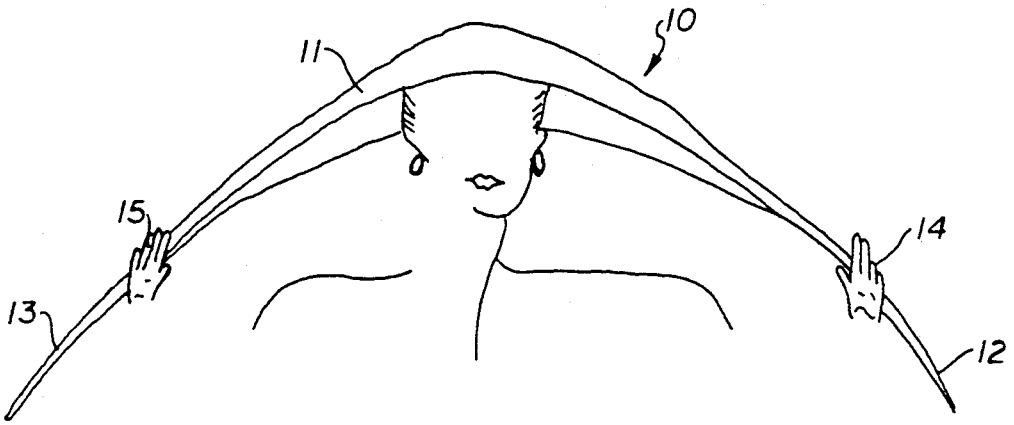
FIG. 1 is a pictorial view of the headwrap, with each tapered end held in one hand of the wearer, and the wide center section draped over the bare head of the wearer, or if desired, on the head on which hair has regrown.

In FIG. 1 is shown the preferred embodiment of headwrap 10 in its simplest form. The wide center section 11 tapers to left end 12 and right end 13 held in left hand 14 and right hand 15, respectively. It must be realized that various shapes, dimensions, and proportions, of section 11, and ends 12 and 13, may be used with various materials and colors, without departing from the intent and spirit of the present invention.

FIGS. 2, 3, 4, and 5 are pictorial illustrations of various methods of arranging the wrap, with and without accessories, from the basic position shown in FIG. 1.

Figure 2:
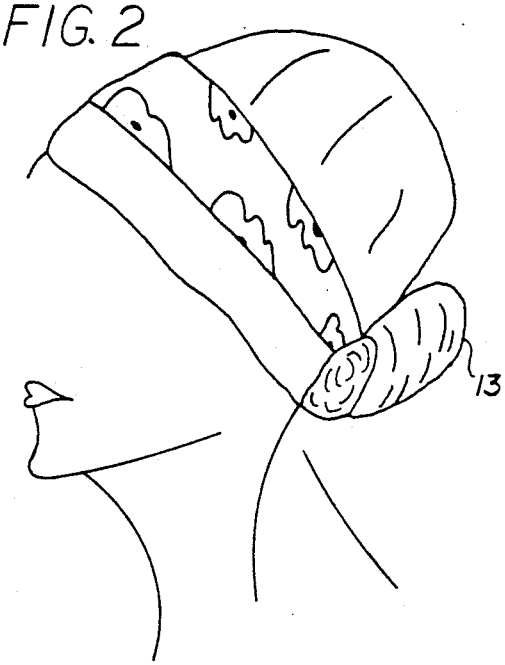
FIGS. 2, 3, 4, and 5 are pictorial illustrations of various methods of arranging the wrap, with and without accessories, starting from the basic position shown in FIG. 1.
Figure 3:
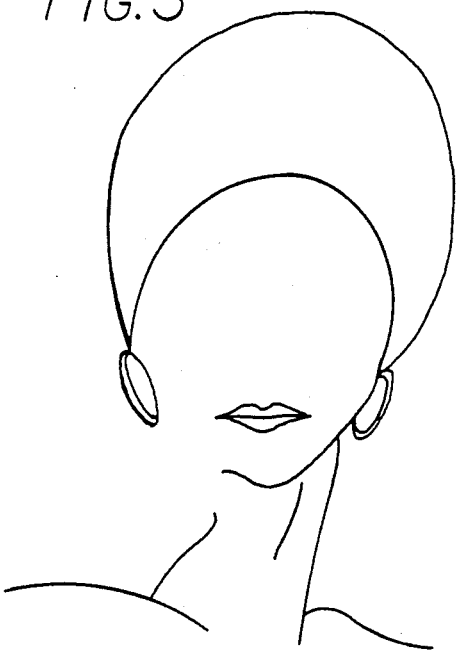
Figure 4:
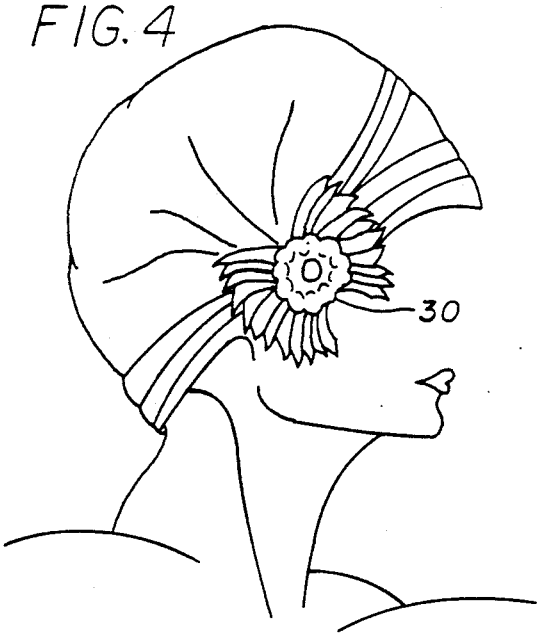
Figure 5:
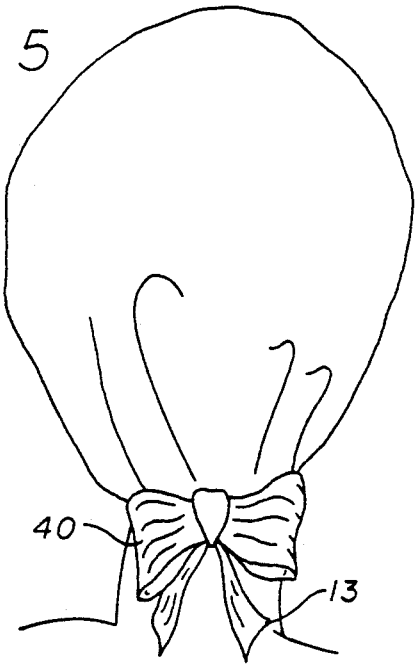

FIGS. 2 and 3 show simple methods of using the headwrap with the ends 13 and 14 secured within its folds. FIG. 4 shows the application of a decorative pin 30. FIG. 5 shows how a bow 40 may be tied stylishly with the tapered ends 12 and 13 of the headwrap. It should also be noted that the wrap may also be used as a sash around the waist in similar manner.

FIGS. 6, 7, 8, 9, 10, and 11 are illustrative pictorial sketches of some of the many methods of wrap arrangement taught by this invention, with and without accessories. FIGS. 12 and 13 include hats 50 and 51 respectively. All of these begin with the basic position shown in FIG. 1, and as noted by the inventor, result in "Wrapture" for the wearer.

Figure 14:
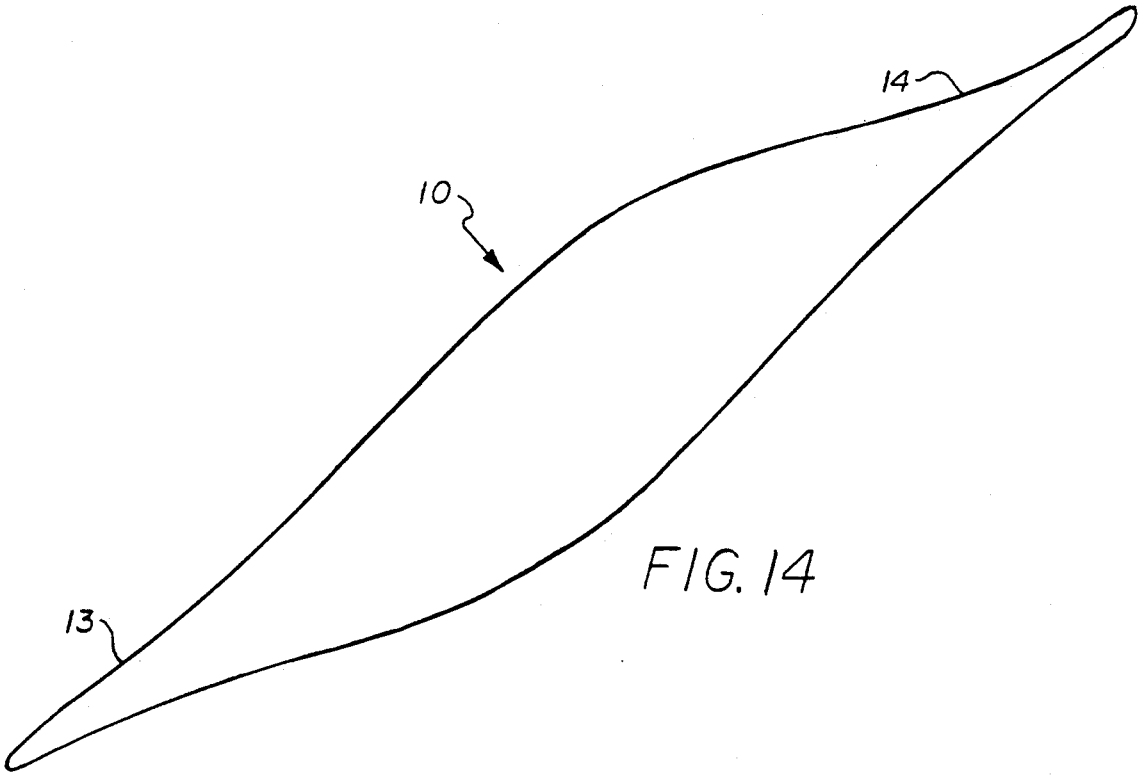
FIG. 14 is an outline pattern drawing of a generic embodiment of the wrap as fabricated and sewn by the inventor.

FIG. 14 is an outline pattern drawing of a generic embodiment of the wrap 10 as fabricated and sewn by the inventor.

What is claimed is:

1. A headwrap for wear by chemotherapy patients (1) to stylishly conceal hair loss during chemotherapy treatment and during subsequent hair regrowth and (2) for stylish wear after said regrowth, said headwrap being knitted from a blend of threads selected from (a) a class of cottons and (b) a class having elastic properties, into a scarf-like shape, said headwrap having body heat-retaining properties provided by said cotton, said headwrap being non-slipping with respect to a head by means of said threads having said elastic properties, a length of said headwrap being greater than a width, said width tapering to narrow securable ends, said tapering allowing for securing of said wrap in at least one distinctive and stylish way, and said wrap conforming adjustably to the shape of said head, keeping said head warm, and securely gripping said head of said patient during period of said hair loss, during said hair regrowth and after said regrowth.

* * * * *